US007625146B2

(12) United States Patent
Vogel

(10) Patent No.: US 7,625,146 B2
(45) Date of Patent: Dec. 1, 2009

(54) METHOD AND SYSTEM FOR CUSTOM PAPER CUTTING

(75) Inventor: Vincent Philip Vogel, Hawthorne, CA (US)

(73) Assignee: Xerox Corporation, Norwalk, CT (US)

( * ) Notice: Subject to any disclaimer, the term of this patent is extended or adjusted under 35 U.S.C. 154(b) by 124 days.

(21) Appl. No.: 11/093,966

(22) Filed: Mar. 30, 2005

(65) Prior Publication Data

US 2006/0228151 A1 Oct. 12, 2006

(51) Int. Cl.
*B41J 11/00* (2006.01)

(52) U.S. Cl. ..... 400/621; 83/237; 83/213; 400/578

(58) Field of Classification Search ..... 400/621, 400/578; 399/385; 271/9.1; 83/237, 213
See application file for complete search history.

(56) References Cited

U.S. PATENT DOCUMENTS

| | | | | | |
|---|---|---|---|---|---|
| 1,978,966 | A * | 10/1934 | Sprague | 234/75 |
| 3,021,999 | A * | 2/1962 | Blanz | 234/87 |
| 3,029,774 | A * | 4/1962 | Namenyi-Katz | 118/668 |
| 3,477,322 | A * | 11/1969 | Gerber et. al. | 83/76.5 |
| 4,419,913 | A * | 12/1983 | Schutt et al. | 83/27 |
| 4,467,525 | A * | 8/1984 | Logan et al. | 33/18.2 |
| 4,704,927 | A * | 11/1987 | Hirosawa | 83/13 |
| 4,819,021 | A * | 4/1989 | Doery | 399/382 |
| 5,141,572 | A * | 8/1992 | Gerber | 156/64 |
| 5,296,906 | A * | 3/1994 | Hano et al. | 399/385 |
| 5,386,283 | A * | 1/1995 | Yang et al. | 399/385 |
| 5,767,984 | A * | 6/1998 | Momonani | 358/304 |
| 5,823,691 | A * | 10/1998 | Langner | 400/127 |
| RE36,112 | E * | 2/1999 | Hano et al. | 399/385 |
| 5,875,383 | A * | 2/1999 | Stemmle | 399/384 |
| 6,072,596 | A * | 6/2000 | Hattori et al. | 358/401 |
| 6,091,928 | A * | 7/2000 | Fuchisawa | 399/384 |
| 6,594,026 | B2 * | 7/2003 | MacDonald | 358/1.12 |
| 6,830,304 | B2 | 12/2004 | Suzuki et al. | |
| 6,883,408 | B2 * | 4/2005 | Shinga | 83/13 |
| 2001/0055044 | A1 | 12/2001 | Matsumoto et al. | |
| 2003/0202835 | A1 * | 10/2003 | Sakurai et al. | 400/621 |
| 2003/0210943 | A1 * | 11/2003 | Nedblake et al. | 400/621 |
| 2004/0085422 | A1 * | 5/2004 | Kelley | 347/101 |
| 2004/0096253 | A1 * | 5/2004 | Ueno et al. | 399/385 |
| 2005/0241445 | A1 * | 11/2005 | Schaede | 83/13 |

FOREIGN PATENT DOCUMENTS

| | | | |
|---|---|---|---|
| EP | 1096781 | A2 * | 5/2001 |
| GB | 2281055 | A * | 2/1995 |
| JP | 2003292230 | A * | 10/2003 |

* cited by examiner

*Primary Examiner*—Ren L Yan
*Assistant Examiner*—Matthew G Marini
(74) *Attorney, Agent, or Firm*—Maginot, Moore & Beck

(57) ABSTRACT

A system automatically cuts recording media into non-standard sizes and shapes. The system includes a support for supporting recording media, a feeder mechanism for transporting recording media onto the support, a cutting head having at least one cutting member, and a controller for actuating reciprocation of the cutting member so that the reciprocating cutting member cooperates with the support to pierce the recording media. The cutting head and feeder mechanism are controlled so that the cutting head is moved to positions for cutting the recording media as the recording media is advanced on the support.

7 Claims, 7 Drawing Sheets

METHOD AND SYSTEM FOR CUSTOM PAPER CUTTING

FIELD OF THE INVENTION

The present invention relates generally to paper cutting machines, and more particularly, to automated paper cutting machines.

BACKGROUND OF THE INVENTION

Electrophotographic printers have achieved a substantial level of sophistication. These printers provide documents with text and images having a variety of color shades or shades of black and white. The capabilities of these printers have enabled users to produce intricate documents with fanciful designs not previously thought possible.

While the capabilities of such printers have increased dramatically, these printers still produce images on sheet media. Although electrophotographic printers may be provided with multiple media trays so that the images may be provided on different sizes of media sheets, the media sheets remain rectilinear in shape with standard sizes. As a consequence, users of electrophotographic printers have been able to print text and designs for photographs, greeting cards, labels, and brochures, but the non-standard shapes and sizes typically desired for many of these projects requires additional processing.

For example, grade school teachers frequently prepare crafts for completion by their classes. While they are able to print indicia for a craft on paper sheets, such as a pumpkin face, they typically must cut the sheets into pumpkin shapes by hand using scissors. Even when the project or craft is simply smaller, but in the same shape as the paper sheets on which the indicia are printed, the user typically takes the printed sheets to a manual paper cutter for trimming to the appropriate dimensions. Frequently, the user may attempt to cut more sheets than the cutting arm can effectively cut leading to user frustration with the throughput of such paper cutting devices.

The current alternatives to after-printing cutting of media sheets are to purchase custom cut paper or to use automatic paper cutters. Both of these options are relatively expensive as custom paper cutting may require significant numbers before a printing shop will reduce its prices to what is perceived as a reasonable level. Because most classes and business meetings are relatively small, print shops with automatic paper cutting facilities are typically not an acceptable option for obtaining custom paper sizes and shapes. Most automatic paper cutters suffer from a number of limitations. For one, they only cut straight lines and do not offer much assistance to those seeking more fanciful design cuts. Additionally, the costs of purchasing automatic paper cutters generally preclude them from being purchased for a school, home, or small business.

What is needed is a custom paper cutter that may be used to generate non-standard paper sizes and shapes cost effectively for small batches.

SUMMARY OF THE INVENTION

The present invention addresses the need for such a custom paper cutter, as well as others, by providing a system for automatically cutting paper with a movable and selectively actuated cutting head. The system includes a support for supporting recording media, a feeder mechanism for transporting recording media onto the support, a cutting head having at least one cutting member, and a controller for actuating reciprocation of the cutting member so that the reciprocating cutting member cooperates with the support to pierce the recording media and for moving the cutting head so that the cutting member is moved to another location proximate the recording media. The support member may be a roller having a deformable surface for absorbing the impact of the cutting member or it may be a platform member having a slot through which the cutting member extends to cut the recording media. By moving the cutting head across the recording media and selectively actuating the cutting member, designs may be cut with curvaceous or slanting segments.

An electrophotographic system may include the cutting system so indicia that have been fixed on recording media may be cut from the recording media. Such an electrophotographic system includes a photoreceptor, a charging station for charging the photoreceptor, a raster output scanner for selectively discharging the photoreceptor to form a latent image on the raster output scanner, a development system for developing toner on the latent image, a recording media feeder for transporting recording media into a position proximate the developed latent image on the photoreceptor, a fuser station for transferring the developed latent image onto the recording media, and a cutting station for cutting the recording media. The system may also be provided with a scanner to scan the document image after it is affixed to the recording media. The document image may then be used by the controller of the system to determine how to actuate the cutting members of the cutting head to cut a pattern in the recording media without destroying the image.

A method for automatically cutting paper includes transporting recording media onto a support, moving a cutting head having at least one cutting member to a position over the recording media on the support, and actuating a reciprocating cutting member so that the reciprocating cutting member cooperates with the support to pierce the recording media. The actuation may be an actuation of a single cutting member or the independent actuation of cutting members within a plurality of cutting members. The cutting member may be received in the support after it pierces the recording media or it may be received in an opening in the support after it pierces the recording media.

The above described features and advantages, as well as others, will become more readily apparent to those of ordinary skill in the art by reference to the following detailed description and accompanying drawings.

DETAILED DESCRIPTION

Figure 1:
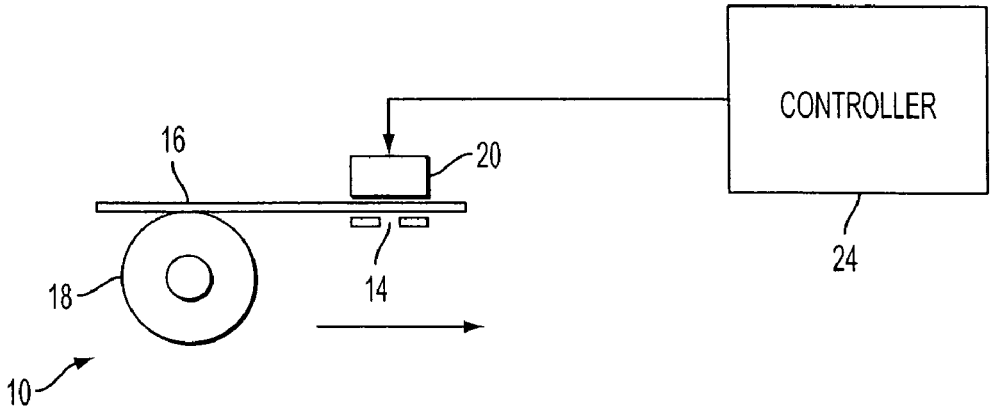
FIG. 1 shows an embodiment of a cutting system for automatically cutting recording media.

FIG. 1 shows a system 10 for automatically cutting paper comprising a support 14 for supporting recording media, a feeder mechanism 18 for transporting recording media 16 onto the support, a cutting head 20 having at least one cutting member, and a controller 24 for actuating a reciprocating cutting member so that the reciprocating cutting member cooperates with the support 14 to pierce the recording media and for moving the cutting head 20 so that the cutting member is moved to another location proximate the recording media. The system 10 may be enclosed in a housing, such as the ones known for stand alone printers, to provide a stand alone media cutter. The recording media may be paper sheets that are stored in a paper tray and transported in the direction indicated by the arrow to the support 14 for cutting by the cutting head 20. As described in more detail below, the cutting head 20 is mounted on a driving screw so it slides horizontally across a space in which a surface of the recording media is exposed. The movement of the cutting head 20 and the reciprocation of the cutting member at various positions are controlled by controller 24.

The controller 24 may include a touch screen user interface so that a user may define a shape to be cut in the paper. Alternatively, the controller 24 may be coupled to a user's computer in which a cutter driver is provided in a manner similar to a printer driver. The cutter driver in such an embodiment is a computer program that executes in the user computer and communicates with the controller 24 in the system 10. The communication may be indirect, as through a computer network, or directly, as when a computer is coupled by an interface cable to an external device. The cutter driver obtains data from the controller 24 regarding the capabilities of the cutter system 10 and provides a graphic user interface (GUI) so that a user is able to define a shape to be cut from a selected paper size. In this manner, a cut job may be generated in a way that is similar to the generation of a print job currently.

Upon receipt of a cut job, either through an interface at system 10 or through a computer coupled to the system, the controller 24 is able to determine where the cutting head 20 should be moved before operating the cutting member to pierce the recording media. The controller continues to move the cutting head 20 and operate the head 20 to cut the recording media at selected positions until it reaches the end of its horizontal travel. The controller 24 then advances the feeder mechanism 18 so that the recording media moves a distance that corresponds to the size of the cutting member. The controller then reverses the direction of the cutting head travel, stopping the cutting head at appropriate locations, and operating the cutting member. This action continues until the design defined in the print job is completed and the recording media is ejected from the system 10.

Figure 2A:
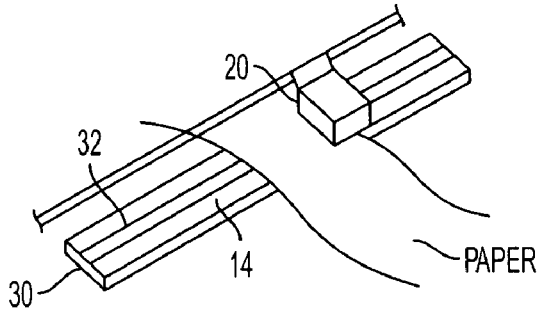
FIG. 2A shows an embodiment of the cutting system of FIG. 1 having a planar support with a slot for receiving a cutting member.
Figure 2B:
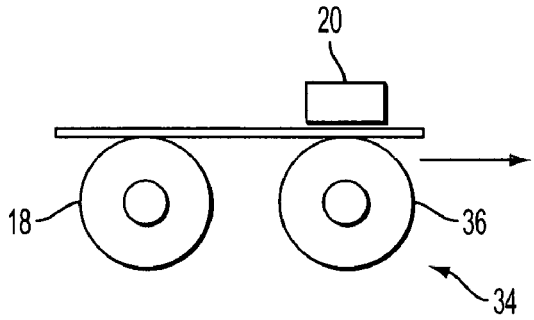
FIG. 2B shows an embodiment of a cutting system having a roller with a deformable surface to receive a cutting member that pierces a recording media.

In one embodiment, the support 14 of system 10 may be a platform 30 having a slot opening 32, as shown in FIG. 2A, to receive the cutting member after it pierces the recording media. The planar area of the platform 30 supports the recording media, such as a sheet of paper, to facilitate the piercing of an area by a cutting member in the cutting head 20. Alternatively, the support 14 may be a roller 34 having a deformable surface 36, as shown in FIG. 2B. The deformable surface enables the roller 34 to resiliently receive the tip of the cutting member after it pierces the recording media without excessively wearing the tip. If the roller 34 had a metal surface, such as stainless steel or aluminum, the tip would degrade significantly from impacting the roller and would be unlikely to pierce or cut the recording media cleanly. Likewise, such a roller would suffer scoring and other damage from the impacts received from the cutting head.

Figure 3:
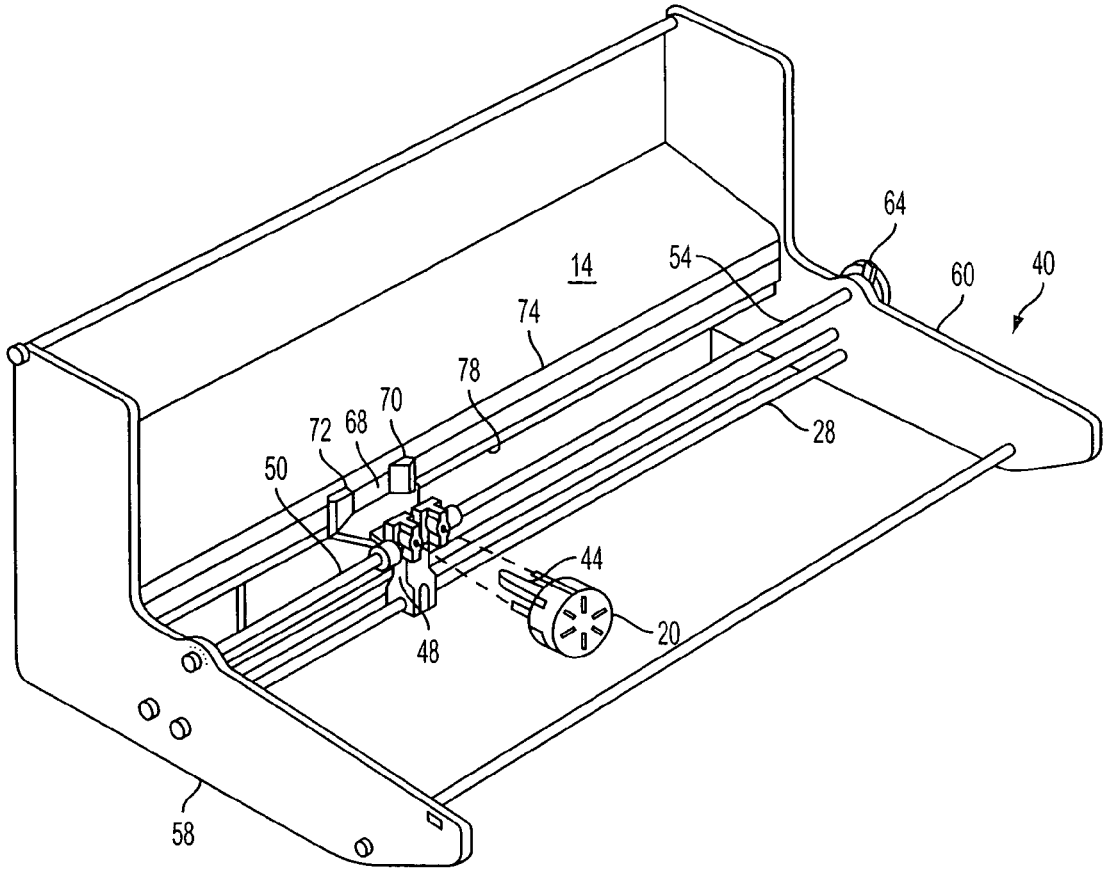
FIG. 3 shows an elevational view of an embodiment of a carriage assembly for moving a cutting head across a recording media for cutting of the media.

A carriage assembly 40 for mounting the cutting head 20 within a housing for a stand alone cutting unit is shown in FIG. 3. The cutting head 20 and its cutting member 44 are mounted to carriage bracket 48 with screws, rivets, or other known mechanical fasteners. The bracket 48 includes a journal 50 through which a drive screw 54 extends. The drive screw 54 is mounted at one end to sidewall 58 by mechanical fasteners and through a mounting hole in sidewall 60 so it terminates into drive wheel 64. Drive wheel 64 is driven by an electrical motor (not shown), such as a stepping motor, for example, that is controlled by controller 24. Control of the electrical motor causes drive screw 54 to rotate and the carriage bracket 48 carrying the cutting head 20 to traverse across the opening between sidewalls 58 and 60.

The cutting member 44 reciprocates through a gate opening 68 between posts 72 and 70. Gate opening 68 is also formed by the front edges 74 and 78 of the support 14. In FIG. 3, the support 14 may be viewed as a U-shaped member mounted or formed between sidewalls 58 and 60 or as two planar members separated by a gap. The longitudinal gap extending between the sidewalls 58 and 60 may also be provided by a single planar member rotated ninety degrees to the upper planar surface shown in FIG. 3 for support 14 and transversely mounted or formed between sidewalls 58 and 60. A gap would be provided in such a planar member so gate 68 may be formed as the carriage bracket 48 is moved by the drive screw 54. While the gate 68 is illustrated as being between posts 72 and 74, posts 72 and 74 are not required for operation of the cutting machine. Likewise, drive screw 54 is described as the transporter of carriage bracket 48 and cutting head 20 between the sidewalls 58 and 60. Other known mechanisms may be used to move the cutting head 20 across the carriage through which recording media are provided, such as those previously provided for ink jet print heads, typewriter print heads, and the like. Such methods include a cable mechanism driven by an electric motor.

Figure 4:
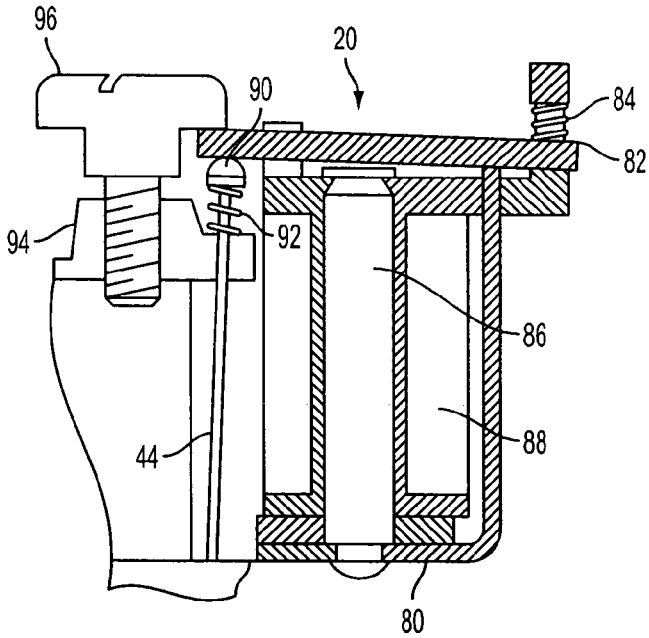
FIG. 4 shows a cross-section view of a cutting head that may be used in an automatic cutting system.

The cutting head 20 is shown in more detail in FIG. 4. The cutting head 20 has a body 80 over which an actuating arm 82 is held at one end by a restraining spring 84. The other end of the actuating arm 82 is trapped between a restraining screw 96 and a head of the cutting member 44. The midpoint of the actuating arm 82 is urged upwardly by a cap over an armature core 86. Wrapped around the core 86 is an armature winding 88. The cutting member 44 extends through an opening in stop member 94 as well as through biasing spring 92. In response to the controller 24 asserting a signal, a current is passed through winding 88 to pull actuating arm 82 against cutting member head 90 so that the cutting end of the cutting member 44 extends into the gate 68 to pierce a recording media. The stop member 94 prevents the head 90 of the cutting member 44 from extending too far beyond the cutting head 20. When the controller 24 terminates the signal, the current ceases to flow through the winding 88 and the biasing spring 92 urges the head 90 back and the actuating arm 82 is returned to a position against the head of the restraining screw 96. The cutting member 44 may terminate into any appropriately shaped end useful for cutting. For example, the cutting end of the member 44 may terminate into a needle point, a slant end, or a flat end.

A cutting head 20 may be comprised of a plurality of cutting members, the cutting members being independently actuated to reciprocate and pierce the recording media. The plurality of cutting members may be arranged in a row or a column matrix or in a row by column matrix. Alternatively, a plurality of cutting members may be arranged in other geometrical patterns to facilitate pattern cutting on a recording media. By selectively driving the cutting members in a plurality of cutting members, designs of various shapes may be cut in the recording member as the cutting head moves across the recording media and the recording media is advanced past the cutting head. The electrical motor that drives the carriage bracket 48 across the carriage assembly may advance the cutting head at a distance that is approximately a little less than the width of one cutting member so that a generally continuous cut is formed in the recording media as the cutting head 20 travels across the carriage assembly. The vertical advancement of the recording media is likewise approximately a little less than the height of the cutting member to continue cut lines commenced in previous rows across the recording member. The controller 24 selectively actuates the cutting member as it travels across the carriage assembly by controlling the assertion of the actuating signal to each armature in the cutting head 20. While the actuation of the cutting members has been described with reference to an electromagnetic actuator, other forms of actuation may be used. For example, pneumatic systems or piezoelectric drivers may be used to actuate the cutting members in a cutting head 20.

Figure 5A:
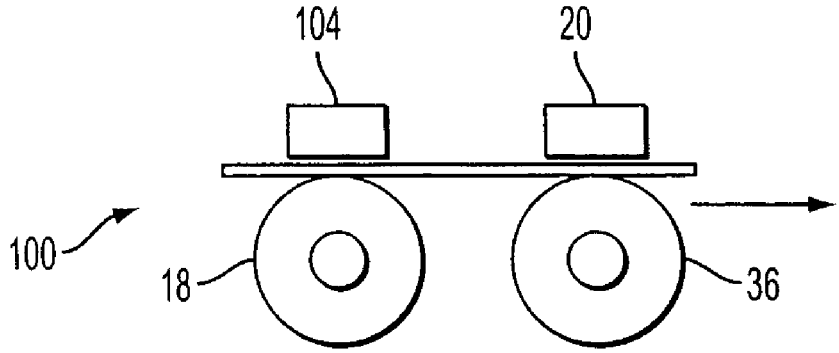
FIG. 5A and FIG. 5B show alternative embodiments of a cutting system used with an electrophotographic system.
Figure 5B:
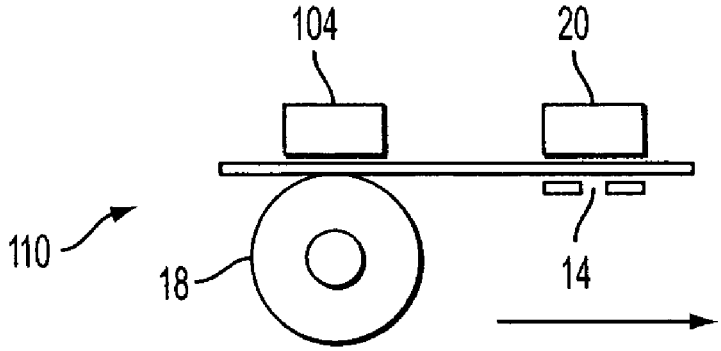

The cutting head 20 may be incorporated with an electrophotographic system to provide cutting and/or trimming of the recording media on which indicia have been printed. As shown in FIG. 5A, an electrophotographic system may be provided with a feeder mechanism 18 that is opposite a printing head 104. The feeder mechanism 18 transports recording media on which indicia have been printed from the printing head 104 to the roller support 36 so that the cutting head 20 may be controlled to cut the recording media. An alternative embodiment is shown in FIG. 4B. System 110 in FIG. 5B provides a feeder 18 opposite the printing head 104 to transport the recording media on which indicia have been printed from the printing head 104 to the slotted support 14. Cutting head 20 may then be operated to cut and/or trim the recording media as it advances past the slot in support 14.

Figure 6A:
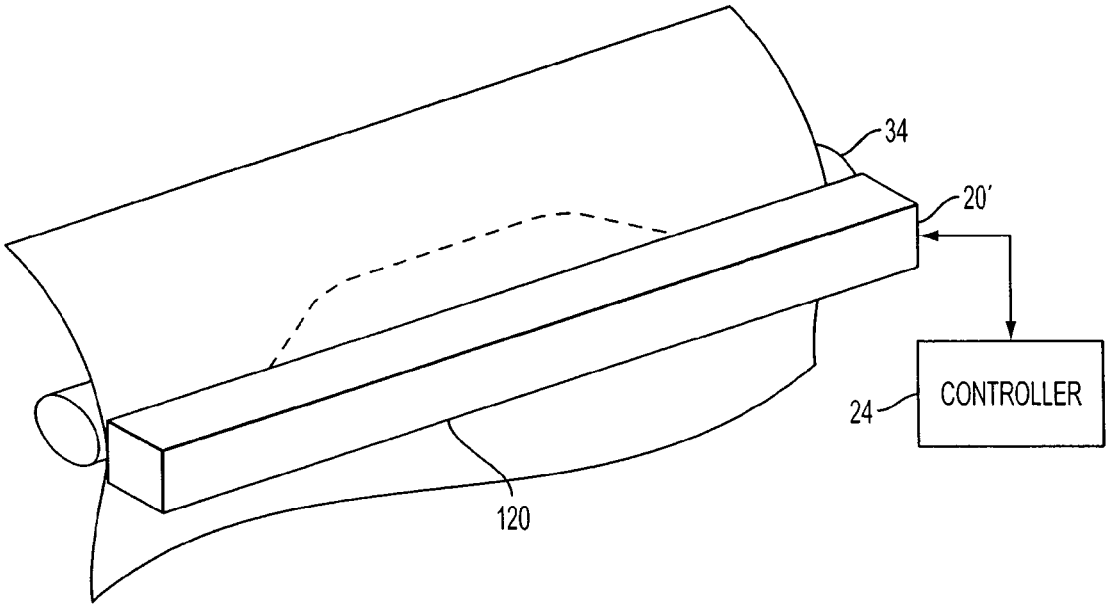
FIG. 6A is an elevational view of another embodiment of the cutting head that remains stationary.
Figure 6B:
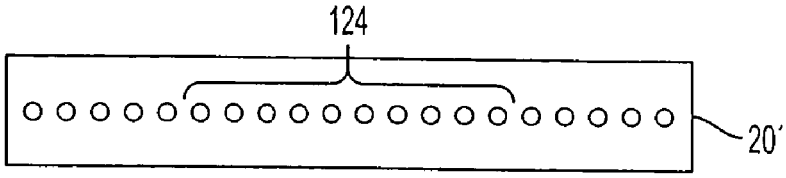
FIG. 6B is a depiction of the stationary cutting head in FIG. 6A having a single row of cutting members.
Figure 6C:
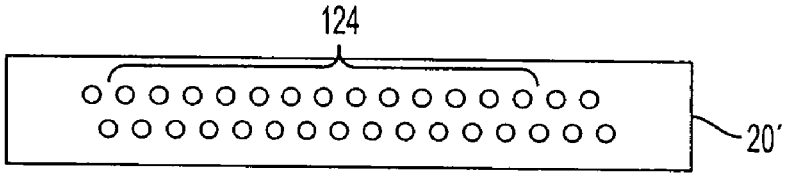
FIG. 6C is a depiction of the stationary cutting head in FIG. 6A having multiple rows of cutting members.

An alternative embodiment of the cutting head is shown in FIG. 6A. The cutting head 20' has a housing 120 that substantially extends across a carriage assembly. Within the housing 120 are a plurality of cutting members 44 that may be actuated to cut a recording media sheet passing between the cutting head 20' and the roller 34. The controller 24 is coupled electrically or pneumatically to the actuators for the cutting members within the housing 120. As the cutting members are selectively actuated by the controller 24 and the sheet of recording media is advanced through the carriage assembly, a cut is formed in the recording media. The apertures 124 through the cutting members 44 extend may be arranged in a single row, as shown in FIG. 6B, or in multiple rows that may be offset from one another, as shown in FIG. 6C.

Figure 7:
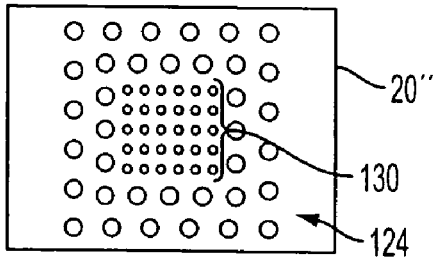
FIG. 7 is a depiction of an arrangement of ink jets and cutting member apertures in an integrated cutting head that both prints and cuts recording media sheets.

In another embodiment of cutting head 20", the cutting members 44 may be integrated with ink jets 130 as shown in FIG. 7. The ink jets 130 may be placed in a matrix that is internal to the arrangement of cutting member apertures 124. The ink jets may be controlled by the controller 24 in a known manner to generate characters on the cutting media. The controller 24 also selectively actuates the cutting members 44 in the cutting head 20" to cut a design in the recording media as it is advanced.

The controller 24 may receive the data by which it actuates the cutting members in any of the embodiments of the cutting head by a variety of mechanisms. One way of providing the cutting data to the controller 24 is through the document data. For example, document data may be formatted within a document so that it may be rendered into multiple bit streams for controlling the modulation of raster scanner light sources. Typically, a color document is comprised of multiple color components with each one being used to produce a color component on the photoreceptor at separate development stations or on different passes of the photoreceptor in the electrophotographic machine. The format of the document may be modified to include cutting data that may be used by the controller 24 to modulate the actuation of the cutting members 44 in one of the cutting heads. In one embodiment, the user may activate a cutting outline function and move a mouse over the face of a document displayed inside a word processing or document rendering program to draw a cutting outline. The locations defined by the cutting outline may then be converted into cutting vectors or bit-mapped cutting locations that are embedded in the document data. When the electronic document is communicated to a system having a cutting head, the controller receives the cutting vectors or bit-mapped cutting locations and actuates the cutting members accordingly.

In a system incorporating a scanner with the cutting head, which is described in more detail below, a user may draw a cutting outline on a recording media sheet on which indicia have already been printed. The scanner then scans the document as it is advanced in a stand alone cutting system. Detection of the cutting outline may be performed through edge detection masks and processing in a known manner. The controller 24 receives the data regarding the detected locations of the cutting outline and selectively actuates the cutting members 44 to cut the recording media sheet along the cutting outline. The user, through a graphic user interface (GUI) or the like, may specify whether the controller is to cut inside or outside of the cutting outline.

In another embodiment of a recording media cutting system, a scanner is interposed between an electrophotographic system and the feeder mechanism so the scanner scans the indicia printed on the recording media to generate a document image and the controller receives the document image from the scanner for generating the control signals used to actuate the cutting member. In this embodiment, the controller is able to determine an image outline from the document image and control the actuation of the cutting member in the cutting head to cut the image outline from the recording media as the recording media passes the cutting head. The controller 24 may convert the document image into a bit mapped image, if the image is not provided as a bit mapped image. The bit mapped image may be used to detect a perimeter for the image. This perimeter may then be used as a pattern for selectively actuating the cutting member(s) of the cutting head 20 to cut the document image from the recording image on which it has been fixed.

Figure 8:
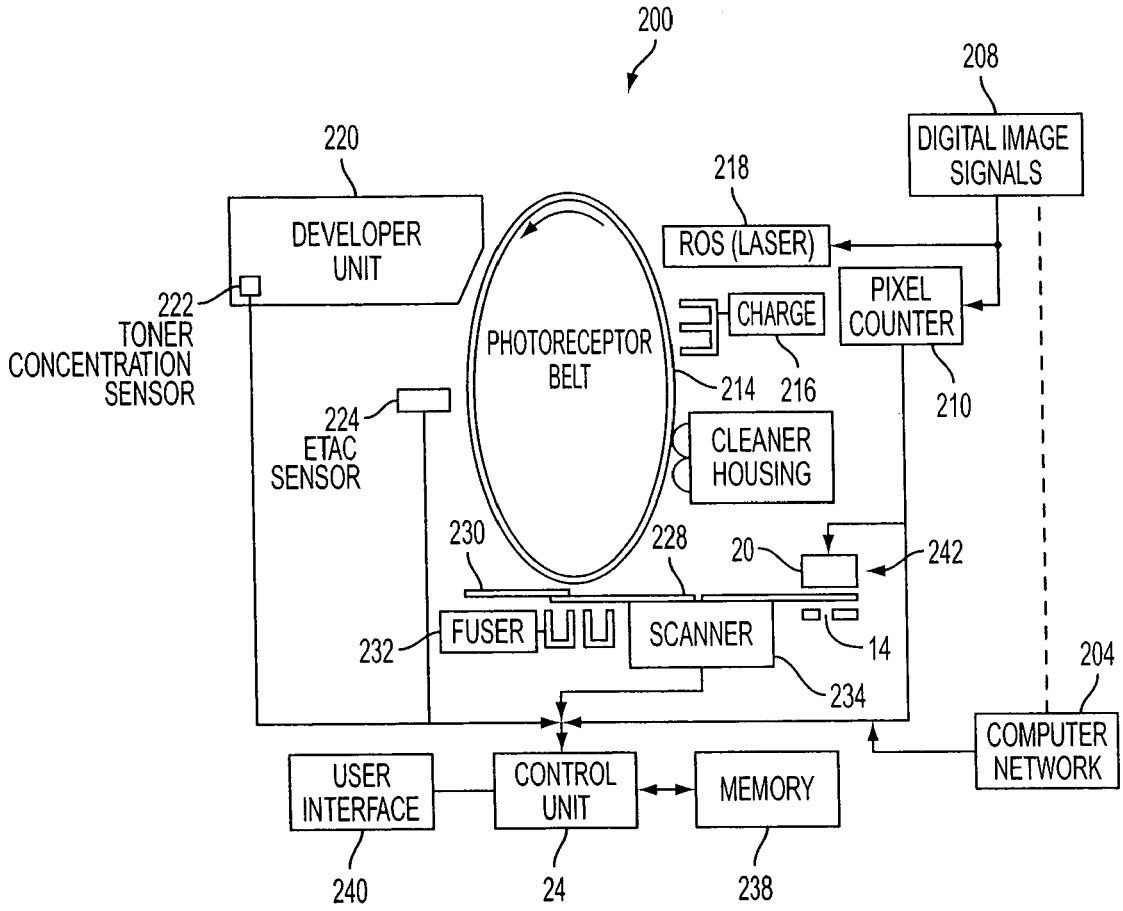
FIG. 8 shows an electrophotographic system having a cutting station and a scanner for the generation of a document image used to control the actuation of the cutting members in the cutting station.

An embodiment combining an electrophotographic system and a scanner with a cutting system is shown in FIG. 8. The system 200 includes a photoreceptor 214, a charging station 216 for charging the photoreceptor, a raster output scanner 218 for selectively discharging the photoreceptor to form a latent image on the raster output scanner, a development system 220 for developing toner on the latent image, a recording media feeder 228 for transporting recording media into a position proximate the developed latent image on the photoreceptor, a fuser station 232 for transferring the developed latent image onto the recording media, a scanner 234 for scanning the indicia fused on the recording media to generate a document image, and a cutting station 242 for cutting the recording media. The text and/or images to be processed by the system 200 may be provided from client devices coupled to the system 200 through a computer network 204. The images may be converted into digital image signals by converter 208 for processing by the system 200. The pixel data of the digital image signals may be provided to a pixel counter 210 and controller 24 for control of the electrophotographic and cutting process.

The photoreceptor may be in the form of a belt as shown in FIG. 8. Charging station 216 charges the photoreceptor to an initial charge and the ROS 218 selectively discharges the photoreceptor belt 214 to form a latent image on the photoreceptor. The developer station 220 develops toner on the latent image formed by the ROS 218 in a known manner. The developer station 220 may use a toner concentration sensor 222 and ETAC sensor 224 to monitor the quality of the image development and make adjustments to the developer station operation. The fuser station 232 uses heat and pressure to transfer the toner from the latent image to the recording media 230. The recording media 230 is transported by the feeder mechanism 228 from the fuser station 232 through the scanner 228 to the cutting station 242 where the trimmed and/or cut product is discharged from the system 200. The scanner 228 may operate as described above to generate a document image that is used by the controller 24 to control the actuation of the reciprocating cutting member(s) of the cutting head 20 in cutting station 242. Alternatively, a user may provide the cutting instructions through a user interface 240. In yet another alternative embodiment, the cutting instructions may be provided from a client device executing a cutter driver program. The cutting instructions may be communicated to the controller 24 over the computer network 204.

Figure 9:
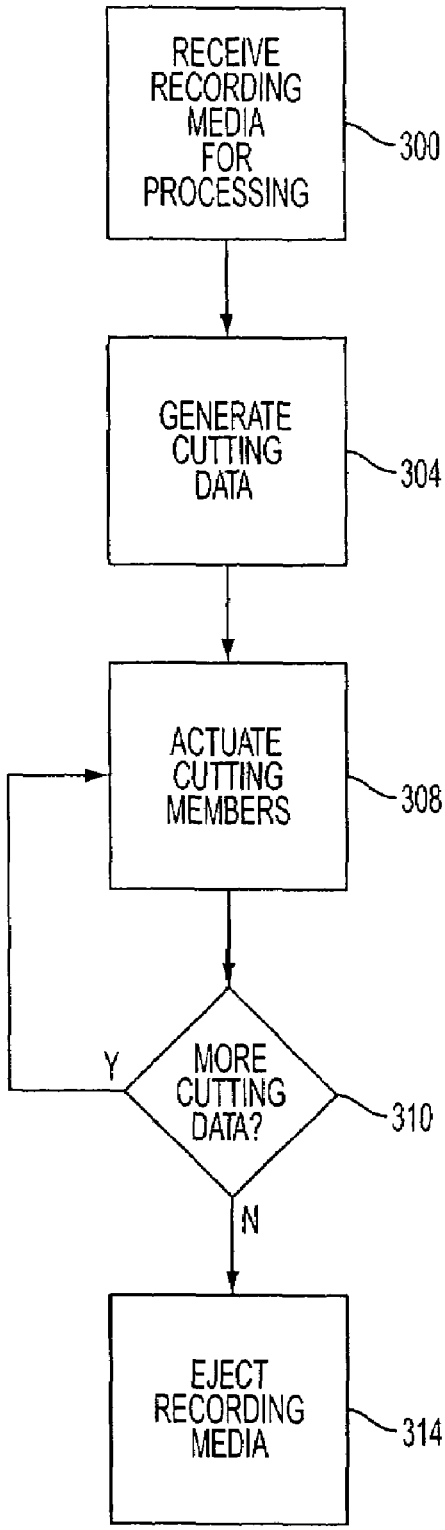
FIG. 9 is a flow diagram of a process for automatically cutting recording media.

A method for automatically cutting paper is shown in FIG. 9. The method includes receiving a recording media sheet for processing (block 300). The recording media sheet may be blank and the device cuts the recording media sheet into a blank form in accordance with generated cutting data. The recording media sheet may also have indicia printed or otherwise imposed on the sheet and the device cuts a design in the sheet for the indicia. If the cutting device is post-printing or stand alone cutting device, the document or recording media sheet is loaded into a supply or feeder for the device that advances recording media sheets to the cutting head. If the cutting device processes electronic documents, then the document may be received through a communication network or other connection or it may be submitted through an appropriate drive from memory media. Cutting data for cutting the recording media is generated (block 304). For a post-printing or stand alone cutting device, the cutting data are generated from scanning indicia on the document as it is advanced to the cutting head or from cutting instructions provided by a user through a GUI or other user interface. Cutting data for electronic documents may be generated from embedded data or cutting vectors provided in the formatted document. Alternatively or additionally, cutting data for electronic documents may be generated from cutting instructions entered by a user through a GUI interface on a display of the document being processed. The cutting data are used to actuate the cutting members of the cutting head as the recording media is advanced through the device (block 308). The reciprocating cutting member cooperates with a support for the recording media to pierce the recording media. The actuation may be an actuation of a single cutting member or the independent actuation of cutting members within a plurality of cutting members. The plurality of cutting members may be provided in a moveable cutting head or in a stationary bar that is opposed to the support. The cutting member may be received in the support after it pierces the recording media or it may be received in an opening in the support after it pierces the recording media. The process determines whether additional cutting data remains (block 310). If there are additional data, the actuation of cutting members continues as the recording media is advanced through the device. Otherwise, the recording media sheet is ejected from the cutting station (block 314).

The method of FIG. 9 may be performed with an electrophotographic system so the recording media on which indicia have been printed by an electrophotographic system are transported from the electrophotographic system to the support. The method may also be performed with a system having a scanner so that the indicia printed on the recording media are scanned to generate a document image and the document image is used to control the actuation of the cutting member. The controller 24 in this embodiment determines an image outline from the document image and cuts the image outline from the recording media with the cutting member of the cutting head.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for automatically cutting paper comprising:

a scanner that scans recording media on which indicia have been printed to generate a document image;

a support for supporting recording media;

a feeder mechanism that transports the recording media from the scanner to the support, the feeder mechanism being configured to advance the recording media by a distance that is less than a cutting member height;

a cutting head having a plurality of cutting members arranged in a matrix in the cutting head, the cutting members being configured for reciprocating movement in which each cutting member is selectively extended from the cutting head in a direction that is generally perpendicular to the recording media to pierce the recording media on the support and then return to the head;

an actuator for each cutting member in the cutting head, each actuator being coupled to a corresponding cutting member;

an electrical motor coupled to the cutting head through a drive member to enable movement of the cutting head across the recording media on the support by a distance that is less than a cutting member width; and a controller coupled to the scanner, the feeder mechanism, the electrical motor, and to each actuator in the cutting head, the controller receiving the document image and detecting an image outline from the document image, the controller using the image outline from the document image to control advancement of the recording media by the feeder mechanism, movement of the cutting head by the electrical motor, and the selective extension of each cutting member from the cutting head to pierce the recording media on which indicia have been printed to form a continuous cut in the recording media.

2. The system of claim 1, the support comprising:

a roller having a deformable surface for receiving the cutting end of the cutting member after it pierces the recording media.

3. The system of claim 1, the support comprising:

a platform having an opening to receive the cutting end of the cutting member after it pierces the recording media.

4. The system of claim 1, wherein the matrix of cutting members in the cutting head being arranged in a row matrix.

5. The system of claim 1, wherein the matrix of cutting members in the cutting head being arranged in a column matrix.

6. A method for automatically cutting paper comprising:

scanning a recording media sheet having indicia printed thereon to generate an electronic document image;

detecting a cutting outline in the electronic document image;

advancing the recording media sheet by a distance that is less than a cutting member height to a position at which a portion of the recording media is opposite a cutting head;

generating cutting data that corresponds to the cutting outline in the electronic document image, the cutting data to be used to control cutting of the recording media sheet;

moving the cutting head across the portion of the recording media opposite the cutting head by a distance that is less than a cutting member width; and selectively actuating each cutting member in a plurality of cutting members arranged in a matrix in the cutting head in accordance with the cutting data corresponding to the cutting outline to reciprocate the cutting members in the plurality of cutting members as the recording media is advanced past the cutting head and the cutting head is moved over the recording media to follow the cutting outline, the cutting member reciprocation including selectively extending the cutting members from the cutting head in a direction that is generally perpendicular to the recording media sheet to pierce a portion of the recording media sheet that is opposite each cutting member and then returning each extended cutting member to the cutting head to form a continuous cut in the recording media.

7. The method of claim 6 further comprising:

supporting the recording media sheet with a deformable surface at a position opposite the cutting head.

* * * * *